United States Patent [19]

Livesay

[11] 4,111,005

[45] Sep. 5, 1978

[54] PRESS-ON PLASTIC BAFFLE FOR ACCUMULATOR-DEHYDRATOR

[75] Inventor: J. D. Livesay, Tipp City, Ohio

[73] Assignee: General Motors Corporation, Detroit, Mich.

[21] Appl. No.: 785,333

[22] Filed: Apr. 7, 1977

[51] Int. Cl.[2] ..... F25B 43/00

[52] U.S. Cl. ..... 62/503; 55/192

[58] Field of Search ..... 62/503; 55/192, 199, 55/463, 35

[56] References Cited

U.S. PATENT DOCUMENTS

| | | | |
|---|---|---|---|
| 1,813,637 | 7/1931 | Powers | 55/463 |
| 3,006,435 | 10/1961 | Alton et al. | 55/463 |
| 3,563,053 | 2/1971 | Bottum | 62/503 |
| 3,721,069 | 3/1973 | Walker | 55/463 |
| 3,796,064 | 3/1974 | Ladusaw | 62/503 |
| 4,041,728 | 8/1977 | Morse et al. | 62/503 |

*Primary Examiner*—C. J. Husar

*Attorney, Agent, or Firm*—Edward P. Barthel

[57] ABSTRACT

In a vehicle air conditioning system, an accumulator-dehydrator including a cylindrical housing with an upstanding standpipe located on the principal axis incorporating an improved plastic baffle having a generally frusto-conical skirt portion and an integral securing portion depending from the baffle closed upper end. The securing portion is spider-like in cross section, providing three spaced upwardly tapered webs each of which supports a vertically extending arcuate rib portion providing a press fit with the standpipe. Each rib terminates in a stop shoulder portion operative to seat on the standpipe open end to define passageways allowing vaporous refrigerant to flow upwardly along the baffle inner wall into the standpipe open end.

2 Claims, 4 Drawing Figures

PRESS-ON PLASTIC BAFFLE FOR ACCUMULATOR-DEHYDRATOR

This invention relates to a suction accumulator for a vehicle air conditioning system and more particularly to an improved suction accumulator-dehydrator baffle incorporation therewith.

In vehicle air conditioning systems, it is known to provide a suction accumulator in an enclosed chamber located between the evaporator and the compressor which serves as a protective device for the compressor. An example of an accumulator-dehydrator assembly is for use in an orifice tube automotive air conditioning system. The accumulator in such a system includes a pressure vessel or housing having an inlet in the upper portion and an outlet standpipe entering the accumulator through the housing bottom. The standpipe extends vertically upward and is open at the top to the interior of the pressure housing to permit the exiting of refrigerant vapor from the housing. A small bleed hole in the outlet standpipe is located near the bottom of the accumulator housing operative for withdrawing oil from the accumulator interior and returning the oil to the compressor.

Prior art accumulator assemblies included the attachment of a bell-shaped deflector or baffle member to the top wall of the accumulator housing, with its side surface extending downwardly around the upper open end of the outlet standpipe. In the prior art such a deflector was formed of metal, preferably aluminum, and secured to the top wall of the accumulator with a spot welding procedure. The fluid from the housing inlet is directed against the outer surface of the baffle such that liquid refrigerant impacting thereagainst is separated from vaporous refrigerant and falls to the bottom of the accumulator housing thus preventing any direct flow of liquid refrigerant into the open end of the outlet standpipe for passage to the compressor. In such prior art accumulators, costly production inspections were required to insure adequate spot welds existed between the baffle and the upper wall of the accumulator housing.

It is thus an object of the present invention to provide an improved accumulator-dehydrator for an automotive air conditioning system which eliminates manufacturing delays associated with spot welding a metallic baffle by providing a plastic baffle with securing means formed integral with the baffle skirt portion allowing a ready press-fit on the upper end of a vertical outlet standpipe located on the principal axis of the accumulator housing.

It is another object of the present invention to provide an improved accumulator-dehydrator incorporating a plastic baffle member slidably mounted on a vertically extending suction outlet tube positioned on the vertical axis of the accumulator cylindrical housing so as to extend from a point adjacent the casing bottom and terminating in an open end located adjacent the housing top wall, the plastic baffle member being slidably mounted in a press-fit manner on the tube upper end. The baffle, having an outer truncated conical portion concentric with the housing, includes securing means in the form of three equally spaced radially extending radial web portions integrally molded on the inner wall of the baffle, the radial webs having a generally triangular outline with each base integrally molded on the inner wall of the baffle and each of the lower leg portions providing an upwardly tapered lead-in edge aligning the baffle for slidable reception on the tube upper end and wherein arcuate sectioned ribs, coextensive with each web upper leg portion, establish a telescopic press-fit with the outlet tube; and wherein each rib has a notched portion adjacent its upper end defining a stop shoulder operative to engage the tube upper open end. The baffle has a closed upper end spaced a predetermined distance above the tube open end to define with the ribs vapor passages therebetween, allowing vaporous refrigerant fluid moving upwardly from the casing bottom along the baffle inner wall to enter into the tube open end via the vapor passages.

Other advantages and features of the improved accumulator-dehydrator assembly will be more readily apparent with reference to the following detailed description in the accompanying drawings in which the preferred embodiment of the invention is illustrated.

IN THE DRAWINGS

Figure 1:
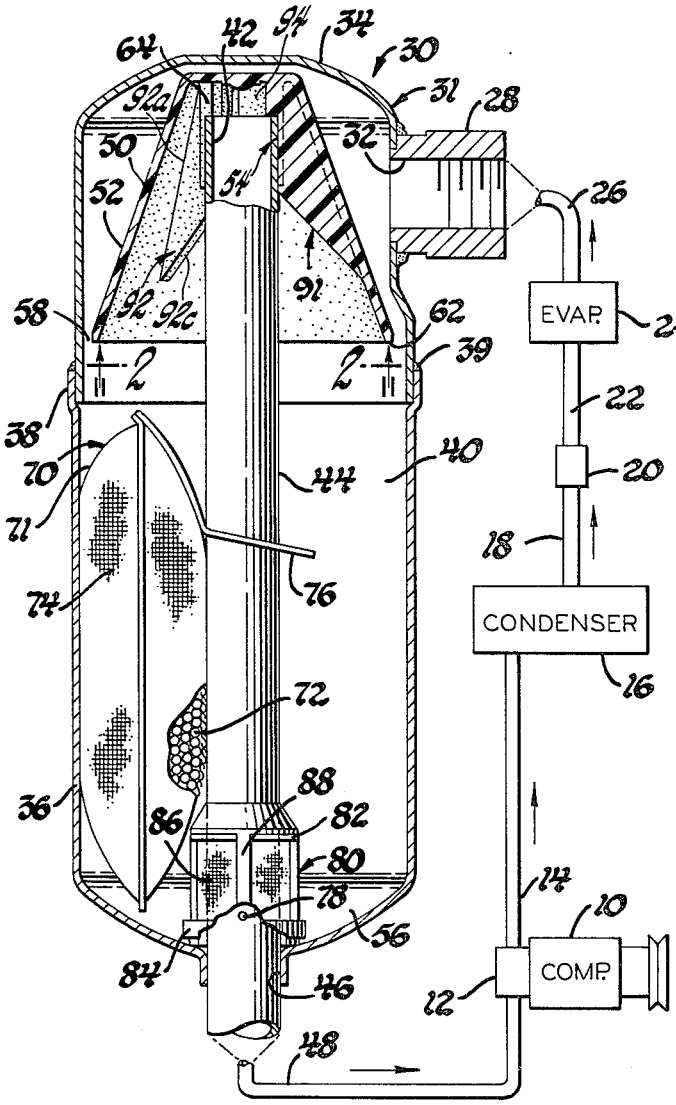
FIG. 1 is a somewhat schematic view of an automotive air conditioning system with a section view of the subject accumulator-dehydrator and improved baffle assembly.

A vehicle air conditioning system is shown schematically in FIG. 1 and includes a compressor 10 for pumping and pressurizing refrigerant. The compressor 10 may be a wobble plate reciprocating axial piston compressor as shown, for example, in U.S. Pat. No. 3,759,058 issued Sept. 18, 1973, and assigned to the assignee of the present application. The compressor 10 includes a fitting 12 at one end which provides an outlet adapted to be connected to a conduit 14 leading to a condenser 16. The condenser 16 is normally placed immediately forward of the vehicle radiator and its purpose is to cool and liquify the hot vaporous refrigerant from the compressor 10. An outlet from the condenser 16 is connected to a conduit 18 which in turn is connected to an inlet or vent orifice tube expander 20. The orifice tube expander is a short length, small diameter tube with associated filters about its end to reduce the pressure of the liquid refrigerant from the condenser and then to pass the lower pressure liquid refrigerant through a conduit 22 to the inlet of an evaporator 24. The low pressure liquid refrigerant enters the bottom end of the evaporator 24 and passes through vertical tubes to the top end while it absorbs heat from the air passing between the tubes of the evaporator, thus cooling the air. While absorbing the heat from the air, the liquid refrigerant is vaporized and passes from the evaporator through a conduit 26 to the inlet fitting 28 of an accumulator dryer generally indicated by the numeral 30.

As seen in FIG. 1, the accumulator-dehydrator assembly 30 includes a cylindrical housing or casing 31 having an inlet 32 to receive refrigerant from the evaporator which refrigerant may contain sufficient amounts of liquified refrigerant along with a vaporous phase. As it is undesirable to pass refrigerant in the liquid phase to the compressor 10, one purpose of the assembly 30 is to separate liquid refrigerant from vaporous refrigerant. For this purpose, the accumulator-dehydrator housing 31 includes an upper walled shell-like member 34 and a lower walled shell-like member 36 which are telescopically joined at a lap joint 38 and sealed by a suitable means such as a weld 39. The housing defines a hollow interior chamber 40 into which the mixture of vaporous and liquid refrigerant pass from the inlet 32. Liquid refrigerant tends to settle toward the bottom of the chamber 40 while vaporous refrigerant is drawn from the top portion of the chamber through an upper opening 42 in a vertically extending suction outlet conduit tube, standpipe or stem pipe 44. The stem pipe 44 extends through an outwardly flared aperture 46 located on the principal axis of the cylindrical housing 31 in the bottom wall thereof and is sealingly attached thereto by suitable means such as welding or brazing. Vaporous refrigerant passes through the stem pipe 44 and enters a conduit or suction line 48 which is attached to fitting 12 of the compressor 10 for returning the vaporous refrigerant to the inlet of the compressor.

Figure 2:
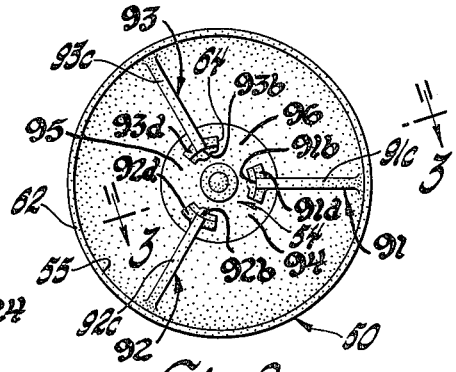
FIG. 2 is a detailed elevational view of the baffle taken substantially on the line 2—2 of FIG. 1.
Figure 3:
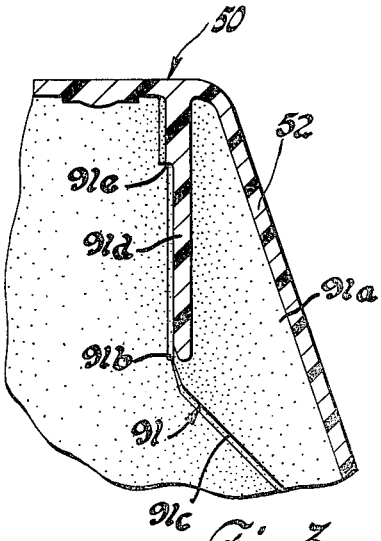
FIG. 3 is an enlarged fragmentary vertical sectional view taken substantially on the line 3—3 of FIG. 2.
Figure 4:
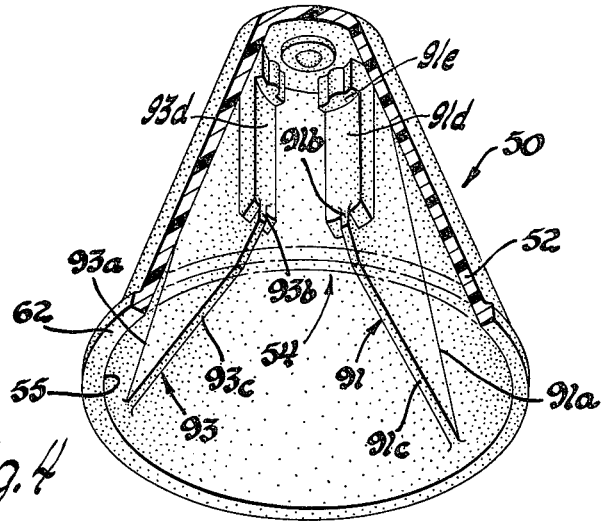
FIG. 4 is a perspective view, with portions broken away, of the plastic baffle of the present invention.

The upper open end of the stem pipe 44 supports an inverted cup-shaped deflector or baffle member, generally indicated at 50, which is the subject of the present invention. The baffle member 50 is molded as a one-piece integral thin-walled member of suitable plastic material, which in the disclosed embodiment is a 30 per cent glass filled polyester material. As best seen in FIGS. 2, 3 and 4, the truncated conical baffle member 50 includes an outer skirt or bell-shaped wall 52, and an inner central press-fit securing means generally indicated at 54. The outer wall has an open lower end 55 positioned below the housing inlet 32 such that the outer wall 52 is upwardly decreasing in cross-sectional area with its maximum outer diameter having a predetermined length less than the inside or internal diameter of the housing 31 to define an annular flow gap 58 therebetween.

In this way refrigerant fluid from the inlet 32 impacts against the outer baffle wall 52. The impact or impinging of the refrigerant mixture on the outer wall 52 tends to cause the liquid portion thereof to separate from the vaporous portion and pass or flow along the outer surface of the wall 52 under the influence of gravity toward the sump portion 56 bottom of the housing 40. Vaporous refrigerant also passes or flows downwardly and around the lower edge 62 of the deflector or baffle 50 for upward flow through the baffle open lower end 55 and thence to the open upper end 42 of the stem pipe 44 via a plurality of baffle openings 64 to be described. It will be noted that accumulated liquid refrigerant in the housing sump portion 56 will eventually vaporize due to the low pressure conditions which normally exist within the accumulator 30 as a result of the continual evacuation thereof by the compressor 10.

It will be noted that the accumulator-dehydrator 30 performs an additional function of removing moisture which may be mixed with the refrigerant. For this purpose a desiccant assembly 70 is supported within the chamber 40. The desiccant assembly 70 includes an envelope or bag 71 containing a quantity of moisture-absorbing or desiccant material 72 which in the present embodiment is silica gel particles. The envelope 71 is conveniently made of cloth-like nylon screen material 74, the edges of which are heat-sealed together to form the bag structure 71. A tab portion 76 has an opening therein adapted to encircle the stem pipe 44 and maintain a desiccant assembly in the location shown in FIG. 1. Mositure mixed with the refrigerant in the system will be absorbed by the silica gel particles 72 and held therein to the exclusion of refrigerant.

In addition to liquid refrigerant collecting in the sump portion 56, a quantity of oil will collect in the accumulator-dehydrator chamber 40. The oil is mixed with the refrigerant in the air conditioning system to circulate therewith for lubrication of the compressor 10. To prevent substantial quantities of oil from collecting in the accumulator dryer 30, a small oil bleed hole 78 is provided in the stem pipe 44 near the housing sump 56. Oil and a small quantity of liquid refrigerant is continually drawn into the suction line 48 and back to the compressor 10 to prevent substantial quantities of oil accumulation in the chamber sump 56. To prevent the small oil bleed hole 78 from clogging, a cylindrical screen assembly 80 is supported about the stem pipe 44 and includes molded plastic upper and lower ring support members 82 and 84 respectively, which are heat-sealed to screen-like material 86. A number of connecting portions 88 extend between the ring portions 82 and 84 to strengthen the assembly 80.

With reference to FIGS. 2–4, it will be seen that the baffle securing means 54 are three 120° equally spaced, vertically extending substantially triangular-shaped radial webs 91, 92 and 93, with each web having a base portion **91*a*, 92*a* and 93*a* integrally molded on the inner face of the wall 52. Each web further includes upper 91*b*, 92*b*, 93*b* and 91*c*, 92*c*, 93*c* leg portions. The lower leg portions 91*c*, 92*c* and 93*c* provide upwardly and inwardly tapered lead-in edges which function to align the baffle securing portion 54 for slidable reception on the tube 44 upper end prior to the assembly of the upper shell member 31 on the lower shell member 36**.

As seen in FIG. 2, arcuate sectioned ribs, indicated at **91*d*, 92*d* and 93*d*, are substantially coextensive with their associated upper leg portions 91*b*, 92*b* and 93*b*, respectively. Each of the ribs 91*d*–93*d* subtends a predetermined arc which in the present embodiment is of the order of about 50°. The arcuate ribs are oriented with their centers on the principal axis of the tube 44 to provide a telescopic slidable press-fit with the upper end of the stand pipe or suction tube 44, as shown in the assembled condition in FIG. 1. With reference to FIG. 3, it will be seen that each rib, as exemplified by rib 91*d*, has a notched portion 91*e* adjacent its upper end defining a stop shoulder operative to engage the tube upper open end. By virtue of this arrangement the baffle closed upper end wall is spaced a predetermined distance above the tube open end to define with the arcuate ribs 91*d*–93*d* vapor passage means which in the preferred form are shown as three vapor passages 94, 95 and 96 therebetween. The three vapor passages allow vaporous refrigerant fluid which moves upwardly either from the casing sump portion 56 or around the open lower edge 62 of the baffle and along the baffle inner wall for entrance into the tube open end 42 via the three vapor passages 94–96**.

It will thus be seen that the improved baffle arrangement of the present invention may be assembled quickly and easily on the accumulator stand pipe after which the upper shell portion 34 is telescoped within the offset flange portion of the lower shell and suitably secured thereto as by welding at 39 to complete the assembly of the accumulator.

While the embodiment of the present invention as herein disclosed constitutes a preferred form, it is to be understood that other forms might be adopted.

I claim:

1. A suction accumulator for an automotive air conditioning system including an evaporator comprising, a hollow tubular casing, a suction outlet tube extending vertically within said casing on the principal axis thereof from a point adjacent the casing bottom and terminating in an upper open end located a predetermined distance from the casing top, an inlet connected to the output of the evaporator for injection of high pressure refrigerant fluid into said casing, said inlet located in the casing side wall below said tube upper open end, a plastic baffle member slidably mounted on said tube upper end in substantially concentric relation with said casing, said baffle member including an outer truncated conical baffle and inner central press-fit securing means, said baffle having an open lower end located below said casing inlet and a closed upper end located above said casing inlet, said baffle having an outer wall upwardly decreasing in cross sectional area with its maximum cross sectional area sufficiently less than said casing side wall to provide an annular flow gap therebetween, whereby refrigerant fluid from said inlet impacts against the outer wall of said baffle for gravity flow via said annular gap to the bottom of said casing, said securing means in the form of a plurality of equally spaced, vertically extending, substantially obtuse and triangular-shaped radial webs; each said web having a base portion integrally molded on the inner wall of said baffle and upper and lower leg portions, each of said lower leg portions providing an upwardly tapered lead-in edge so as to align said baffle for slidable reception on said tube upper end, an arcuate sectioned rib coextensive with each upper leg portion, each said rib subtending a predetermined angle, said ribs dimensioned to establish a telescopic press-fit with said tube, each said rib having a notched portion adjacent its upper end defining a stop shoulder operative to engage the tube upper open end, whereby said baffle closed upper end is spaced a predetermined distance above said tube open end to define with said arcuate ribs a plurality of vapor passages therebetween, such that vaporous refrigerant fluid moves upwardly from said casing bottom along said baffle inner wall for entrance into said tube open end via the vapor passages.

2. A suction accumulator for an automotive air conditioning system including an evaporator comprising, a hollow tubular casing, a vertically extending suction outlet tube extending vertically within said casing on the principal axis thereof from a point adjacent the casing bottom and terminating in an upper open end located a predetermined distance from the casing top, an inlet connected to the output of the evaporator for injection of high pressure refrigerant fluid into said casing, said inlet located in the casing side wall below said tube upper open end, a plastic baffle member slidably mounted on said tube upper end concentric with said casing, said baffle member including an outer truncated conical baffle and inner central press-fit securing means, said baffle having an open lower end located below said casing inlet and a closed upper end located above said casing inlet, said baffle having an outer wall upwardly decreasing in cross sectional area with its maximum cross sectional area sufficiently less than said casing side wall to provide an annular flow gap therebetween, whereby refrigerant fluid from said inlet impacts against the outer wall of said baffle for gravity flow via said annular gap to the bottom of said casing, said securing means in the form of three equally spaced, vertically extending, substantially obtuse and triangular-shaped radial webs; each said web having a base portion integrally molded on the inner wall of said baffle and upper and lower leg portions, each of said lower leg portions providing an upwardly tapered lead-in edge so as to align said baffle for slidable reception on said tube upper end, an arcuate sectioned rib coextensive with each upper leg portion, each said rib subtending an angle no more than about 50°, said ribs dimensioned to establish a telescopic press-fit with said tube, each said rib having a notched portion adjacent its upper end defining a stop shoulder operative to engage the tube upper open end, whereby said baffle closed upper end is spaced a predetermined distance above said tube open end to define with said arcuate ribs three vapor passages therebetween, such that vaporous refrigerant fluid moves upwardly from said casing bottom along said baffle inner wall for entrance into said tube open end via the three vapor passages.

* * * * *